US010170864B1

(12) United States Patent
Hsu et al.

(10) Patent No.: US 10,170,864 B1
(45) Date of Patent: Jan. 1, 2019

(54) WATERPROOF CONNECTOR

(71) Applicant: Cheng Uei Precision Industry Co., Ltd., New Taipei (TW)

(72) Inventors: Li-Nien Hsu, New Taipei (TW); Sheng-Nan Yu, New Taipei (TW)

(73) Assignee: CHENG UEI PRECISION INDUSTRY CO., LTD., New Taipei (TW)

( * ) Notice: Subject to any disclaimer, the term of this patent is extended or adjusted under 35 U.S.C. 154(b) by 0 days.

(21) Appl. No.: 15/838,385

(22) Filed: Dec. 12, 2017

(30) Foreign Application Priority Data

Sep. 5, 2017 (TW) ..... 106213170 U

(51) Int. Cl.

| | |
|---|---|
| ***H01R 13/6585*** | (2011.01) |
| ***H01R 24/60*** | (2011.01) |
| ***H01R 13/6581*** | (2011.01) |
| ***H01R 13/52*** | (2006.01) |
| *H01R 107/00* | (2006.01) |
| *H01R 13/405* | (2006.01) |

(52) U.S. Cl.
CPC ..... *H01R 13/6581* (2013.01); *H01R 13/5202* (2013.01); *H01R 13/5213* (2013.01); *H01R 13/5216* (2013.01); *H01R 13/405* (2013.01); *H01R 13/6585* (2013.01); *H01R 24/60* (2013.01); *H01R 2107/00* (2013.01)

(58) Field of Classification Search
CPC ..... H01R 24/60; H01R 13/6585; H01R 13/6581; H01R 2107/00; H01R 13/5202; H01R 13/6594; H01R 12/71; H01R 12/724; H01R 13/405; H01R 13/41; H01R 13/428; H01R 13/504; H01R 13/506; H01R 13/52; H01R 13/58; H01R 13/6474; H01R 13/652; H01R 13/6583; H01R 13/6591; H01R 13/6595; H01R 24/64; H01R 43/24
See application file for complete search history.

(56) References Cited

U.S. PATENT DOCUMENTS

| | | | | |
|---|---|---|---|---|
| 8,851,927 | B2 * | 10/2014 | Hsu | H01R 12/724 439/607.11 |
| 9,425,558 | B1 * | 8/2016 | Hsu | H01R 12/724 |
| 9,496,664 | B2 * | 11/2016 | Little | H01R 13/6587 |
| 9,627,817 | B2 * | 4/2017 | Chang | H01R 13/6594 |
| 9,843,148 | B2 * | 12/2017 | Little | H01R 24/60 |
| 9,865,974 | B2 * | 1/2018 | Chen | H01R 24/62 |

(Continued)

*Primary Examiner* — Amy Cohen Johnson
*Assistant Examiner* — Matthew T Dzierzynski
(74) *Attorney, Agent, or Firm* — Cheng-Ju Chiang

(57) ABSTRACT

A waterproof connector includes a dielectric body, a plurality of terminals integrally molded to the dielectric body, a shielding assembly, a metal shell surrounding outside the dielectric body, and a waterproof housing integrally molded outside the metal shell. The dielectric body has a tongue board. A periphery of a rear of the tongue board is recessed inward to form a limiting groove. A plurality of the blocking boards are protruded from the tongue board and located in front of the limiting groove. The shielding assembly is limited in the limiting groove. Outer surfaces of rear ends of contact portions of the plurality of the terminals adjacent to a front end of the shielding assembly are recessed inward to form a plurality of avoiding areas, each of the plurality of the avoiding areas is matched with one of the plurality of the blocking boards.

20 Claims, 11 Drawing Sheets

(56) References Cited

U.S. PATENT DOCUMENTS

| | | | | |
|---|---|---|---|---|
| 9,991,652 | B2 * | 6/2018 | Tsai | H01R 13/516 |
| 9,997,859 | B2 * | 6/2018 | Yu | H01R 4/2454 |
| 10,008,811 | B2 * | 6/2018 | Ho | H01R 13/6585 |
| 2018/0109042 | A1 * | 4/2018 | Little | H01R 13/405 |

* cited by examiner

WATERPROOF CONNECTOR

CROSS-REFERENCE TO RELATED APPLICATION

The present application is based on, and claims priority form, Taiwan Patent Application No. 106213170, filed Sep. 5, 2017, the disclosure of which is hereby incorporated by reference herein in its entirety.

BACKGROUND OF THE INVENTION

1. Field of the Invention

The present invention generally relates to a connector, and more particularly to a waterproof connector.

2. The Related Art

Nowadays, an electronic product, such as a current hand-held mobile device, generally has a connector for transmitting data or charging. The current hand-held mobile device has a cover which opens an opening. The connector is disposed in the cover of the current hand-held mobile device and exposed to the opening of the cover for facilitating a connection between the connector of the current hand-held mobile device and a docking connector of another electronic device or a charging device. With the rapid development of electronic technologies, universal serial bus (USB) TYPE-C connectors are widely applied by virtue of high speed characteristics, multi-functional transmission characteristics, dual-direction connection characteristics without positive and negative limitations, and ultra-thin characteristics. Nevertheless, in daily lives, raindrops and sweats are inevitably encountered, or negligently overturn beverages etc. Liquids will flow to the current hand-held mobile device, so the current hand-held mobile device will add a waterproof performance design.

For example, a waterproof housing is integrally molded to a shell of the connector, and multiple sealing rings are integrally molded to a front end of the waterproof housing for ensuring a waterproof function between an outside of the connector and the electronic product is normal. Intervals among a dielectric body inside the shell and terminals of the connector are sealed by virtue of a method of the connector being integrally molded for multiple times for ensuring that a waterproof function of an inside space of the connector is normal, so that moistures and liquids in an external environment are prevented from being permeated into the inside space of the connector of the current hand-held mobile device through the intervals of the connector to affect an electrical characteristic and a usage life of the connector of the current hand-held mobile device.

Referring to FIG. 10 and FIG. 11, a conventional waterproof connector 100' is a universal serial bus (USB) TYPE-C connector. The conventional waterproof connector 100' includes a dielectric body 10', a plurality of terminals 20' integrally molded to the dielectric body 10', an inner metal shell 30' surrounding the dielectric body 10' to which the plurality of the terminals 20' are molded, and an outer waterproof housing 40'. A middle of a front surface of the dielectric body 10' protrudes frontward to form a tongue board 11'. The plurality of the terminals 20' are disposed in an upper row and a lower row. Front ends of the plurality of the terminals 20' are exposed to a top surface and a bottom surface of the tongue board 11'. Because the conventional waterproof connector 100' has an ultra-thin thickness, a small volume, and an intensive arrangement of the plurality of the terminals 20', the conventional waterproof connector 100' further includes a shielding assembly 50' for avoiding electromagnetic interferences. The shielding assembly 50' surrounds a rear end of the tongue board 11'. The shielding assembly 50' is located behind the front ends of the plurality of the terminals 20' which are exposed to the top surface and the bottom surface of the tongue board 11'. The shielding assembly 50' abuts against the inner metal shell 30'.

However, a few users are too anxious, the few users inevitably use the waterproof connector 100' before the waterproof connector 100' is dried, when the liquids enter the waterproof connector 100', before the waterproof connector 100' is dried, a front end of the shielding assembly 50' is near to the front ends of the plurality of the terminals 20', when the liquids flow to a position between the front end of the shielding assembly 50' and the front ends of the plurality of the terminals 20', the shielding assembly 50' and the plurality of the terminals 20' are conducting to result in a short circuit. Moreover, a power terminal 21' of the plurality of the terminals 20' is capable of causing a short circuit overburning.

Thus, in order to achieve a better anti-electromagnetic interference effect, how to improve the above-mentioned problems by virtue of a structure design has become an important issue which is to be solved by skilled persons in the art, so an innovative waterproof connector having a reasonable design and effectively improving the above-mentioned problems is needed to be provided.

SUMMARY OF THE INVENTION

An object of the present invention is to provide a waterproof connector. The waterproof connector includes a dielectric body, a plurality of terminals, a shielding assembly, a metal shell, and a waterproof housing integrally molded outside the metal shell. The dielectric body has a base portion, and a tongue board protruded from a middle of a front surface of the base portion. A top surface of a front of the tongue board opens a plurality of upper terminal grooves. A bottom surface of the front of the tongue board opens a plurality of lower terminal grooves. A periphery of a rear of the tongue board is recessed inward to form a limiting groove. A plurality of the blocking boards are protruded into the upper terminal grooves and the lower terminal grooves from the tongue board and located in front of the limiting groove. The plurality of terminals integrally molded to the dielectric body, include a plurality of lower terminals arranged transversely and a plurality of upper terminals arranged transversely. Each of the plurality of the terminals has a fastening portion, a contact portion connected with a front end of the fastening portion, and a soldering portion connected with a rear end of the fastening portion. The fastening portions of the plurality of the terminals are integrally molded in and fastened in the dielectric body. The contact portions of the plurality of the lower terminals and the upper terminals are received in the plurality of the lower terminal grooves and the upper terminal grooves and are exposed to the bottom surface and the top surface of the front of the tongue board. The soldering portions of the plurality of the terminals project beyond a rear surface of the dielectric body. The shielding assembly is limited in the limiting groove of the dielectric body. The metal shell surrounds outside the dielectric body to which the plurality of the terminals are integrally molded. The outer surfaces of rear ends of the contact portions of the plurality of the terminals exposed to the top surface and the bottom surface of the front of the tongue board and adjacent to a front end of the shielding assembly are recessed inward to form a plurality of avoiding areas, each of the plurality of the blocking boards is corresponding to one of the upper terminal grooves and the lower terminal grooves, each of the plurality of the blocking boards is spaced from an inner wall of the one of the upper terminal grooves and the lower terminal grooves facing the blocking board corresponding to the one of the upper terminal grooves and the lower terminal grooves, each of the plurality of the avoiding areas is located under or above one of the plurality of the blocking boards, each of the plurality of the avoiding areas is matched with the one of the plurality of the blocking boards.

Another object of the present invention is to provide a waterproof connector. The waterproof connector includes a dielectric body, a plurality of terminals, a shielding assembly, a metal shell, and a waterproof housing integrally molded outside the metal shell. The dielectric body has a base portion, and a tongue board protruded from a middle of a front surface of the base portion. A top surface of a front of the tongue board opens a plurality of upper terminal grooves. A bottom surface of the front of the tongue board opens a plurality of lower terminal grooves. A periphery of a rear of the tongue board is recessed inward to form a limiting groove. The plurality of terminals integrally molded to the dielectric body, include a plurality of lower terminals arranged transversely and a plurality of upper terminals arranged transversely. Each of the plurality of the terminals has a fastening portion, a contact portion connected with a front end of the fastening portion, and a soldering portion connected with a rear end of the fastening portion. The fastening portions of the plurality of the terminals are integrally molded in and fastened in the dielectric body. The contact portions of the plurality of the lower terminals and the upper terminals are received in the plurality of the lower terminal grooves and the upper terminal grooves and are exposed to the bottom surface and the top surface of the front of the tongue board. The soldering portions of the plurality of the terminals project beyond a rear surface of the dielectric body. The shielding assembly is limited in the limiting groove of the dielectric body. The metal shell surrounds outside the dielectric body to which the plurality of the terminals are integrally molded. A plurality of insulation glues are coated on outer surfaces of rear ends of the contact portions of the plurality of the terminals exposed to the top surface and the bottom surface of the front of the tongue board and adjacent to a front end of the shielding assembly.

Another object of the present invention is to provide a waterproof connector. The waterproof connector includes a dielectric body having a tongue board, at least one terminal, a shielding assembly, and a metal shell surrounding outside the dielectric body. The at least one terminal is received in the dielectric body. The at least one terminal has a fastening portion received in the dielectric body, a contact portion exposed to a surface of the tongue board, and a soldering portion projecting beyond the dielectric body. The shielding assembly is limited in a rear portion of the tongue board. The shielding assembly is capable of an integrative structure. A portion of the contact portion of the at least one terminal adjacent to a front end of the shielding assembly is recessed inward to form an avoiding area, the avoiding area is covered by a part of the surface of the tongue board. A front edge of the shielding assembly is recessed rearwardly to form at least one avoiding groove, the avoiding groove is corresponding to the avoiding area of the at least one terminal along a front-to-rear direction.

As described above, the outer surfaces of the rear ends of the contact portions of the plurality of the terminals exposed to the top surface and the bottom surface of the front of the tongue board and adjacent to the front end of the shielding assembly have a plurality of insulation elements which are the insulation glues or the blocking boards, when the waterproof connector is used before the waterproof connector is dried, the front end of the shielding assembly is near to the rear ends of the contact portions of the plurality of the terminals exposed to the top surface and the bottom surface of the front of the tongue board, when liquids flow to a position between the rear ends of the contact portions of the plurality of the terminals and the front end of the shielding assembly, the rear ends of the contact portions of the plurality of the terminals and the front end of the shielding assembly are prevented from being conducting to cause a short circuit on account of an insulating function of each of the plurality of the insulation elements.

BRIEF DESCRIPTION OF THE DRAWINGS

The present invention will be apparent to those skilled in the art by reading the following description, with reference to the attached drawings, in which.

DETAILED DESCRIPTION OF THE PREFERRED EMBODIMENT

Figure 1:
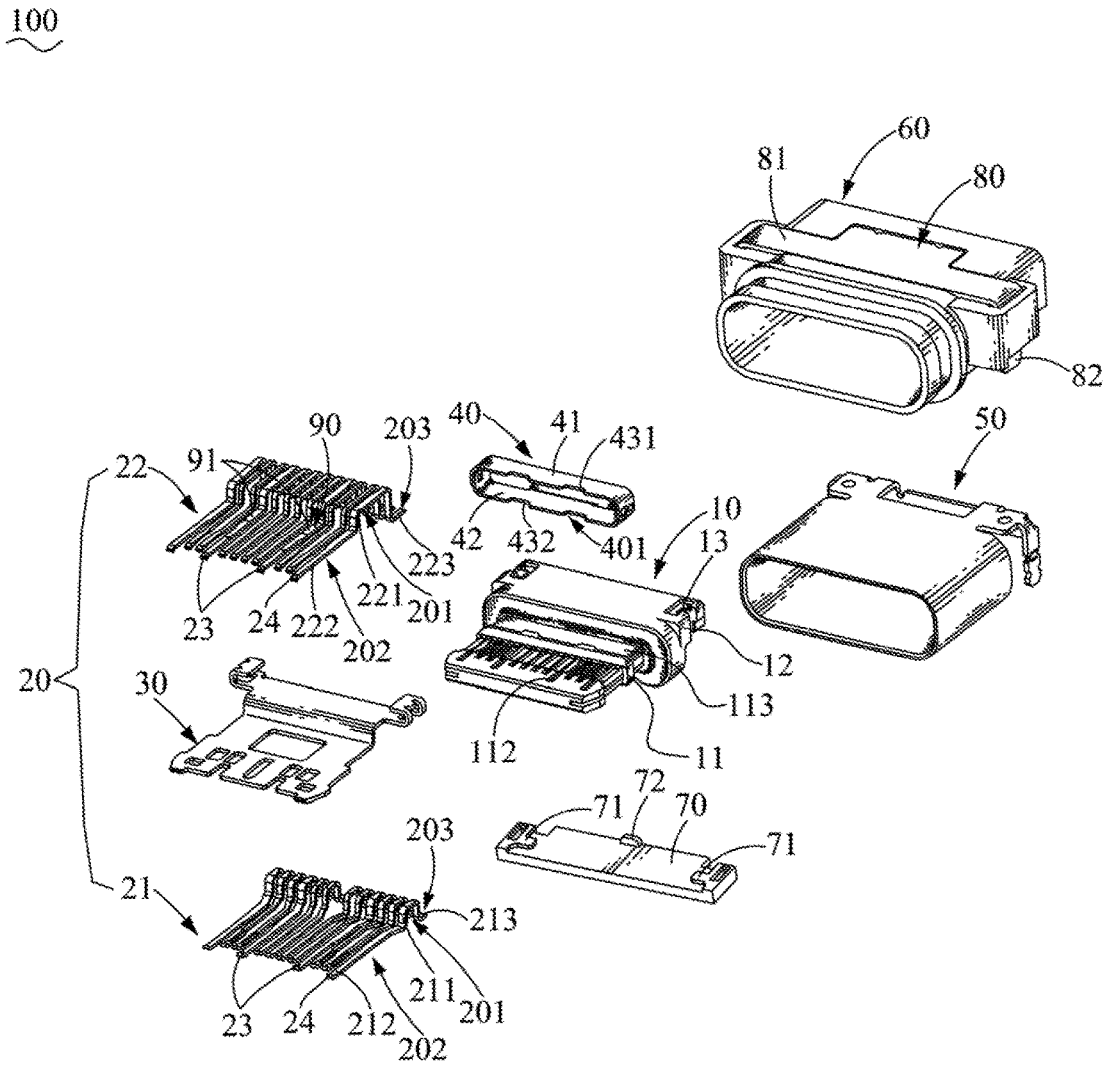
FIG. 1 is an exploded perspective view of a waterproof connector in accordance with a first preferred embodiment of the present invention.

With reference to FIG. 1 to FIG. 8, a waterproof connector 100 in accordance with a first preferred embodiment and a second preferred embodiment of the present invention is shown. The waterproof connector 100 includes a dielectric body 10, a plurality of terminals 20, an isolating plate 30, a shielding assembly 40, a metal shell 50 and a waterproof housing 60.

Referring to FIG. 1 to FIG. 8, the dielectric body 10 is of a rectangular shape. The dielectric body 10 has a base portion 12, and a tongue board 11 protruded from a middle of a front surface of the base portion 12. Two opposite sides of a rear of the dielectric body 10 open two fastening grooves 13. Two opposite sides of the base portion 12 open the two fastening grooves 13. A top surface of a front of the tongue board 11 opens a plurality of upper terminal grooves 112. A bottom surface of the front of the tongue board 11 opens a plurality of lower terminal grooves 111. A periphery of a rear of the tongue board 11 is recessed inward to form a limiting groove 113. A rear end of a bottom surface of the dielectric body 10 is recessed inward to form a lacking groove 14 passing through a rear surface of the dielectric body 10.

Referring to FIG. 1 to FIG. 8, the plurality of the terminals 20 are integrally molded to the dielectric body 10. At least one terminal 20 is received in the dielectric body 10. The plurality of the terminals 20 include a plurality of lower terminals 21 arranged transversely, and a plurality of upper terminals 22 arranged transversely. Each of the plurality of the terminals 20 has a fastening portion 201, a contact portion 202 connected with a front end of the fastening portion 201, and a soldering portion 203 connected with a rear end of the fastening portion 201. The at least one terminal 20 has the fastening portion 201 received in the dielectric body 10, the contact portion 202 exposed to a surface of the tongue board 11, and the soldering portion 203 projecting beyond the dielectric body 10. The fastening portions 201 of the plurality of the terminals 20 are integrally molded in and fastened in the dielectric body 10. The contact portions 202 of the plurality of the lower terminals 21 and the upper terminals 22 are received in the plurality of the lower terminal grooves 111 and the upper terminal grooves 112, and are exposed to the bottom surface and the top surface of the front of the tongue board 11. The soldering portions 203 of the plurality of the terminals 20 project beyond the rear surface of the dielectric body 10.

Specifically, each of the plurality of lower terminals 21 has a lower fastening portion 211, a lower contact portion 212 connected with a front end of the lower fastening portion 211, and a lower soldering portion 213 connected with a rear end of the lower fastening portion 211. Each of the plurality of the upper terminals 22 has an upper fastening portion 221, an upper contact portion 222 connected with a front end of the upper fastening portion 221, and an upper soldering portion 223 connected with a rear end of the upper fastening portion 221. The lower fastening portions 211 of the plurality of lower terminals 21 and the upper fastening portions 221 of the plurality of the upper terminals 22 are integrally molded in and fastened in the dielectric body 10. The lower contact portions 212 of the plurality of the lower terminals 21 are received in the plurality of the lower terminal grooves 111 and are exposed to the bottom surface of the front of the tongue board 11. The upper contact portions 222 of the plurality of the upper terminals 22 are received in the plurality of the upper terminal grooves 112 and are exposed to the top surface of the front of the tongue board 11. The lower soldering portions 213 of the plurality of lower terminals 21 and the upper soldering portions 223 of the plurality of the upper terminals 22 project beyond the rear surface of the dielectric body 10.

Referring to FIG. 1 to FIG. 8, the isolating plate 30 is disposed between the plurality of the lower terminals 21 and the plurality of the upper terminals 22. The isolating plate 30, the plurality of the lower terminals 21 and the plurality of the upper terminals 22 are integrally molded together in the dielectric body 10.

Referring to FIG. 1 to FIG. 8, the shielding assembly 40 is limited in a rear portion of the tongue board 11. The shielding assembly 40 is limited in the limiting groove 113 of the dielectric body 10. The shielding assembly 40 includes an upper shielding element 41 and a lower shielding element 42. The shielding assembly 40 is capable of an integrative structure, so the upper shielding element 41 and the lower shielding element 42 are capable of being integrated into the integrative structure. The upper shielding element 41 is mounted in an upper portion and two opposite sides of the limiting groove 113. The lower shielding element 42 is mounted in a lower portion and the two opposite sides of the limiting groove 113. The upper shielding element 41 and the lower shielding element 42 are fastened with each other by virtue of a buckling way. The upper shielding element 41 and the lower shielding element 42 are fastened with each other by a laser spot welding technology. A front edge of the shielding assembly 40 is recessed rearwardly to form at least one avoiding groove 401. Two opposite sides of a front edge of a top of the upper shielding element 41 are recessed inward to form two first avoiding grooves 431. Two opposite sides of a front edge of a bottom of the lower shielding element 42 are recessed inward to form two second avoiding grooves 432.

Referring to FIG. 1 to FIG. 8, the metal shell 50 surrounds outside the dielectric body 10 to which the plurality of the terminals 20 and the isolating plate 30 are integrally molded.

Referring to FIG. 1 to FIG. 9, the waterproof housing 60 is integrally molded outside the metal shell 50 for ensuring a waterproof function of an inside of the waterproof connector 100 is normal and a waterproof function between an outside of the waterproof connector 100 and an electronic product (not shown) is normal when the waterproof connector 100 is used in the electronic product. A rear end of a bottom of the waterproof housing 60 opens an assembling groove 61 corresponding to upper portions of the soldering portions 203 of the plurality of the terminals 20. The assembling groove 61 is corresponding to the soldering portion 203 of the at least one terminal 20. The assembling groove 61 is communicated with the lacking groove 14. An upper portion of a rear of the waterproof housing 60 opens a rectangular guiding hole 62 penetrating rearward through a rear surface of the waterproof housing 60 and extending forward to the assembling groove 61. A portion of the rear surface of the waterproof housing 60 is recessed inward to form a blocking groove (not shown) communicated with the guiding hole 62. Two opposite sides of a bottom surface of a top wall of the assembling groove 61 protrude downward to form two supporting portions 63 matched with the two fastening grooves 13. The two supporting portions 63 are fastened in the two fastening grooves 13, respectively.

Referring to FIG. 1 to FIG. 9, the waterproof connector 100 further includes a waterproof cover 70. Two opposite sides of a top surface of the waterproof cover 70 protrude upward to form two propping portions 71. A middle of a rear of the waterproof cover 70 protrude upward to form a blocking portion 72. The waterproof cover 70 is integrally molded to the assembling groove 61 and the guiding hole 62, and located above the soldering portions 203 for effectively sealing intervals among the soldering portions 203, the dielectric body 10, the isolating plate 30, the metal shell 50 and the waterproof housing 60 and further ensuring the waterproof function of the inside of the waterproof connector 100 and the waterproof function between the outside of the waterproof connector 100 and the electronic product are normal. The waterproof cover 70 is integrally molded to the assembling groove 61 and the guiding hole 62, and located above the soldering portion 203 of the at least one terminal 20. The two propping portions 71 abut against the two supporting portions 63, respectively. The blocking portion 72 is blocked in the blocking groove.

Referring to FIG. 1 to FIG. 8, the waterproof connector 100 further includes a fastening element 80. The fastening element 80 includes a board-shaped connecting portion 81, and two soldering feet 82 bent downward from two opposite sides of the connecting portion 81. The connecting portion 81 of the fastening element 80 is integrally molded to and fastened to the waterproof housing 60. A top surface of the connecting portion 81 is exposed out of a top surface of the waterproof housing 60. The two soldering feet 82 pass through two opposite sides of the waterproof housing 60 and project beyond bottom surfaces of the two opposite sides of the waterproof housing 60.

Referring to FIG. 1 to FIG. 8, after the waterproof connector 100 is completed being assembled, the lower shielding element 42 abuts against a bottom plate of the metal shell 50. A front end of the shielding assembly 40 is near to rear ends of the contact portions 202 of the plurality of the terminals 20 exposed to the top surface and the bottom surface of the front of the tongue board 11 for preventing liquids entering a position between the rear ends of the contact portions 202 of the plurality of the terminals 20 and the front end of the shielding assembly 40 to cause a short circuit. Outer surfaces of the rear ends of the contact portions 202 of the plurality of the terminals 20 exposed to the top surface and the bottom surface of the front of the tongue board 11 and adjacent to the front end of the shielding assembly 40 have a plurality of insulation elements 90.

Referring to FIG. 1 to FIG. 8, specifically, the plurality of the terminals 20 include a plurality of power terminals 23 integrally molded to the dielectric body 10, and a plurality of signal terminals 24 integrally molded to the dielectric body 10. The plurality of the upper terminals 22 include two power terminals 23. The plurality of the lower terminals 21 include two power terminals 23. The plurality of the power terminals 23 are capable of causing a short circuit overburning. The rear ends of the contact portions 202 of the plurality of the power terminals 23 are located in front of the two first avoiding grooves 431 and the two second avoiding grooves 432 separately. An insulating distance between the front end of the shielding assembly 40 and the rear ends of the contact portions 202 of the plurality of the power terminals 23 is increased by virtue of the two first avoiding grooves 431 and the two second avoiding grooves 432. Outer surfaces of rear ends of the contact portions 202 of the plurality of the power terminals 23 exposed to the top surface and the bottom surface of the front of the tongue board 11 and adjacent to the front end of the shielding assembly 40 have the plurality of the insulation elements 90.

In the first preferred embodiment, the insulation elements 90 are a plurality of insulation glues 91. The outer surfaces of the rear ends of the contact portions 202 of the plurality of the power terminals 23 exposed to the top surface and the bottom surface of the front of the tongue board 11 and adjacent to the front end of the shielding assembly 40 are coated with the plurality of the insulation glues 91.

Figure 2:
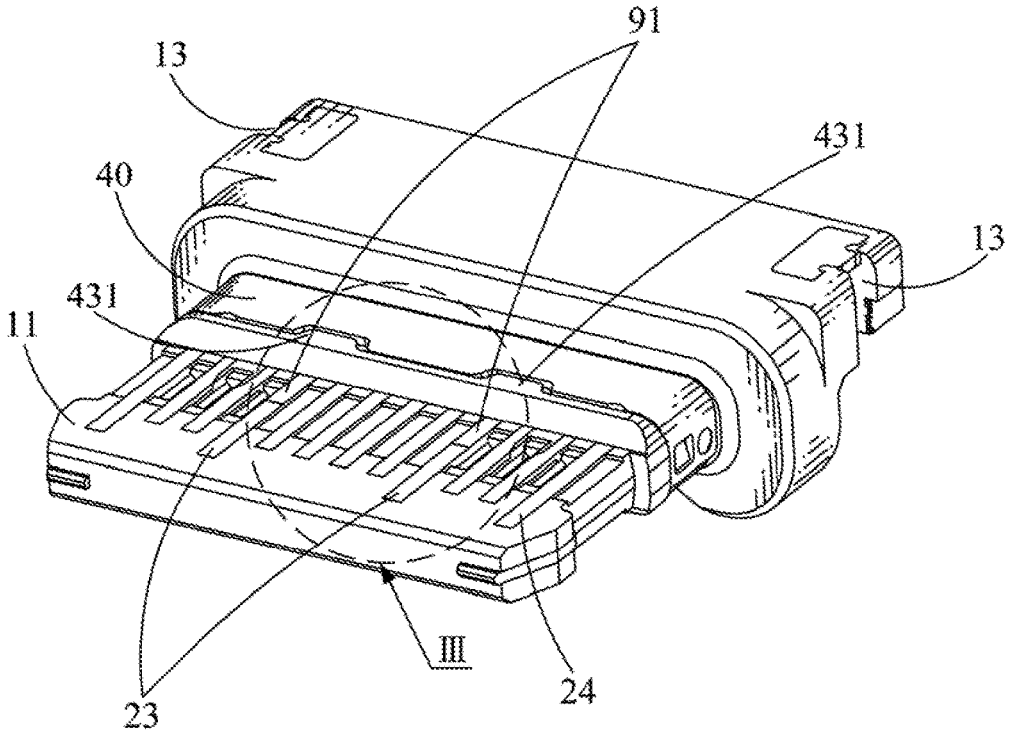
FIG. 2 is a partially perspective view of the waterproof connector of FIG. 1, wherein a plurality of terminals and an isolating board are integrally molded to a dielectric body.
Figure 3:
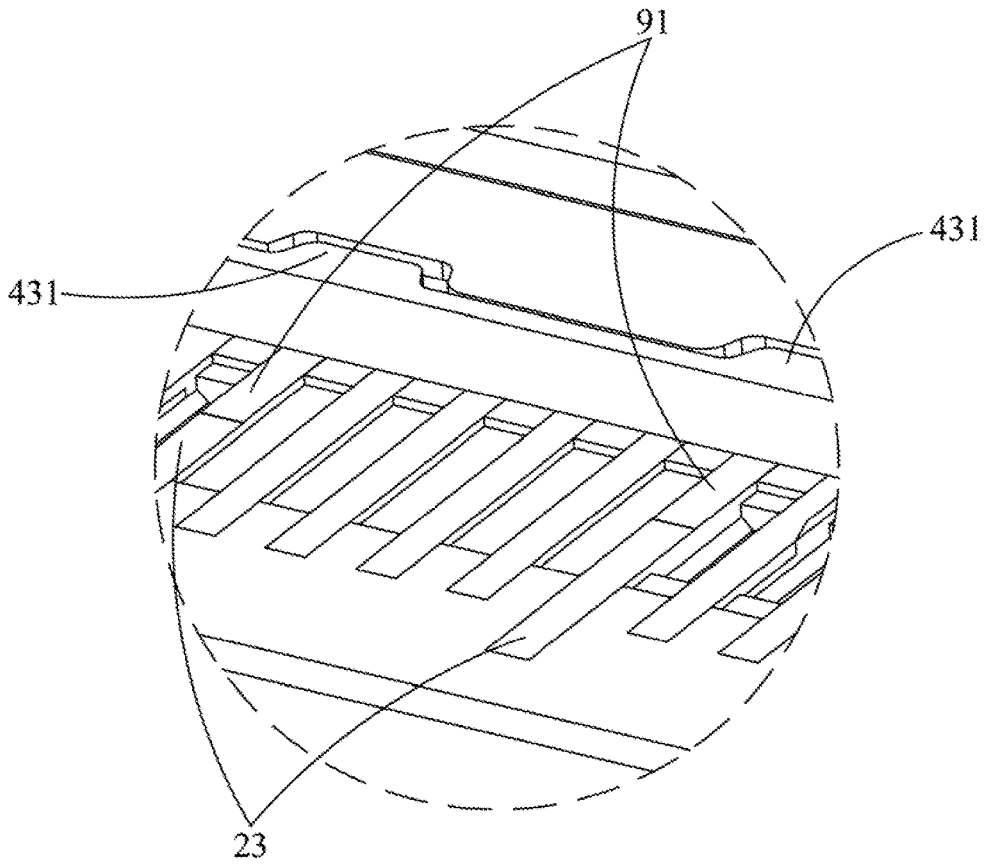
FIG. 3 is an enlarged view of an encircled portion III of the waterproof connector of FIG. 2.
Figure 4:
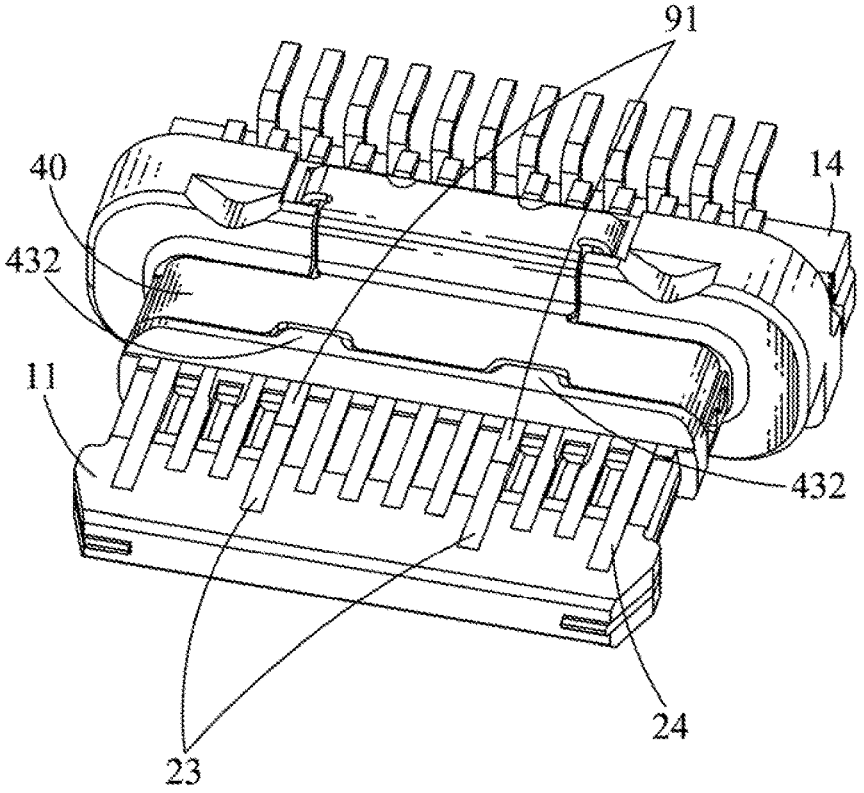
FIG. 4 is another partially perspective view of the waterproof connector of FIG. 1, wherein the plurality of terminals and the isolating board are integrally molded to the dielectric body.
Figure 5:
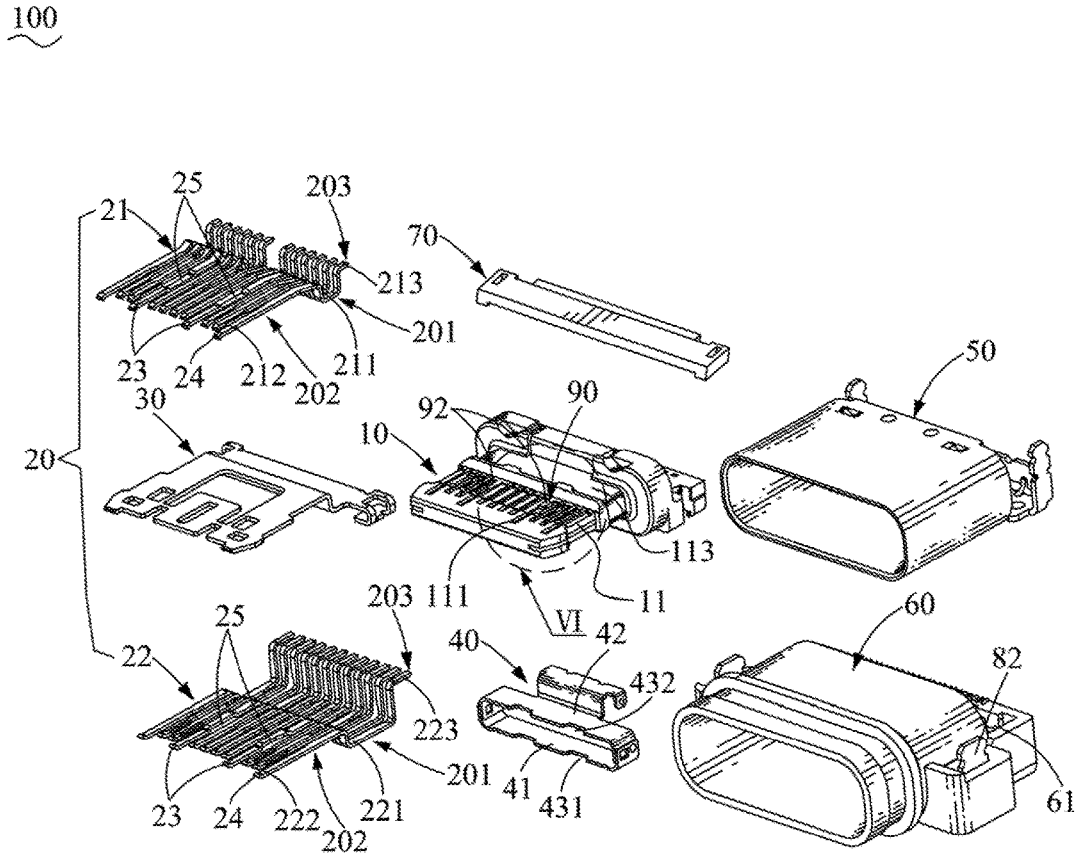
FIG. 5 is an exploded perspective view of the waterproof connector in accordance with a second preferred embodiment of the present invention.
Figure 6:
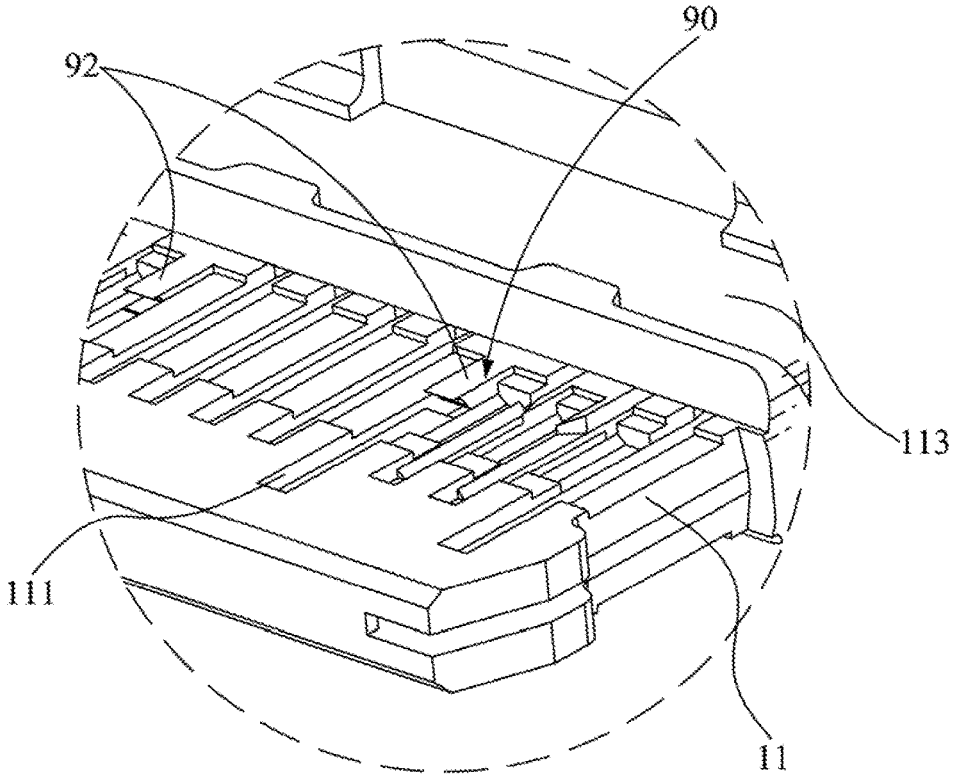
FIG. 6 is an enlarged view of an encircled portion VI of the waterproof connector of FIG. 5.
Figure 7:
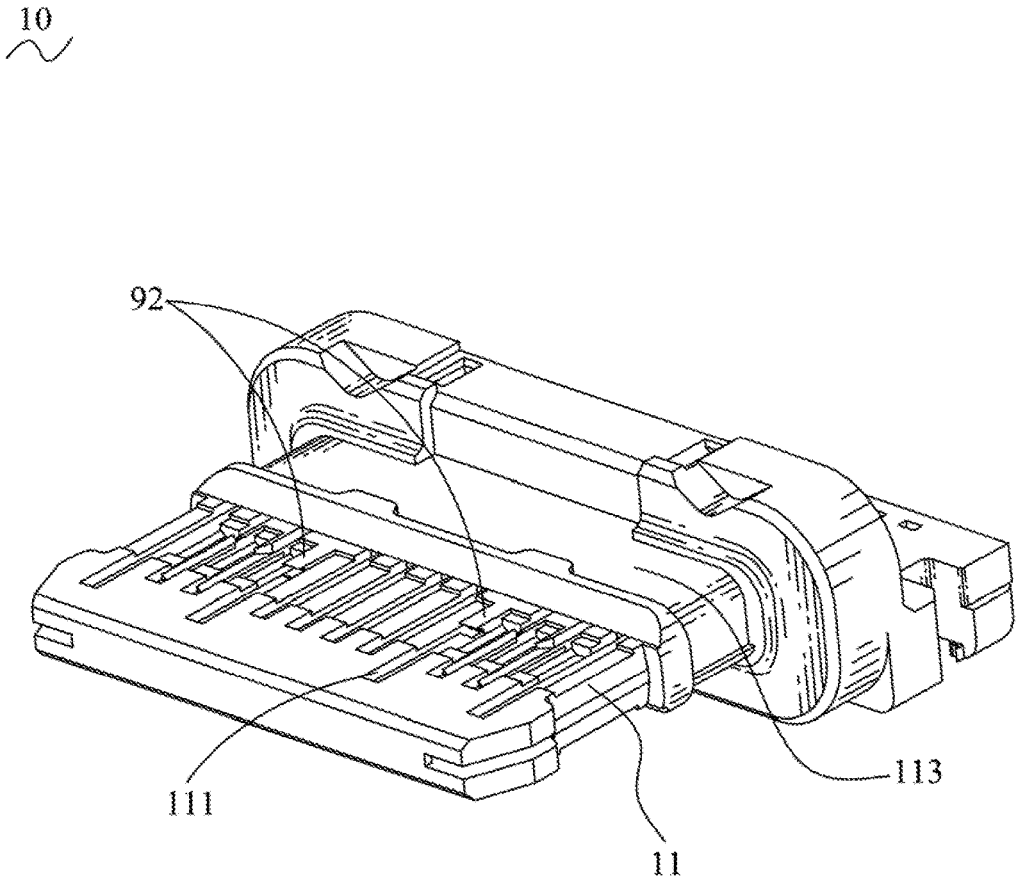
FIG. 7 is a perspective view of the dielectric body of the waterproof connector of FIG. 5.
Figure 8:
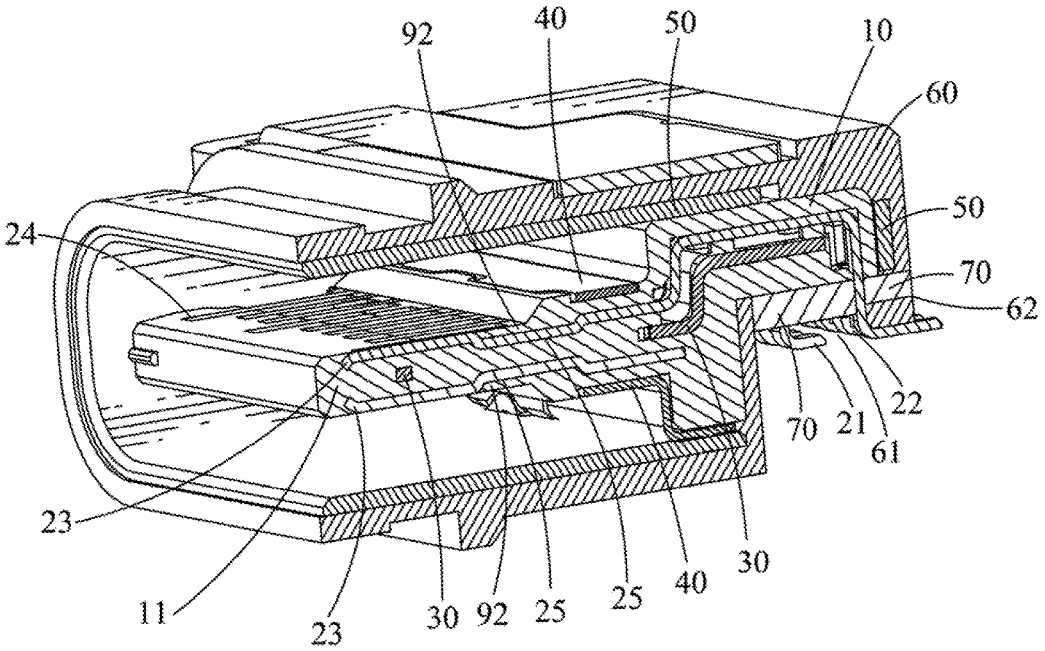
FIG. 8 is a cross-sectional perspective view of the waterproof connector of FIG. 5.
Figure 9:
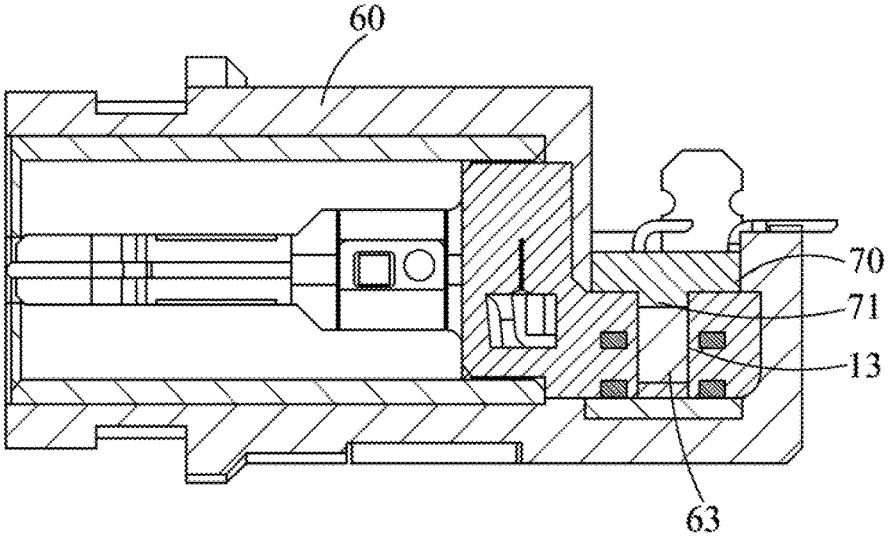
FIG. 9 is a cross-sectional perspective view of the waterproof connector in accordance with the present invention.
Figure 10:
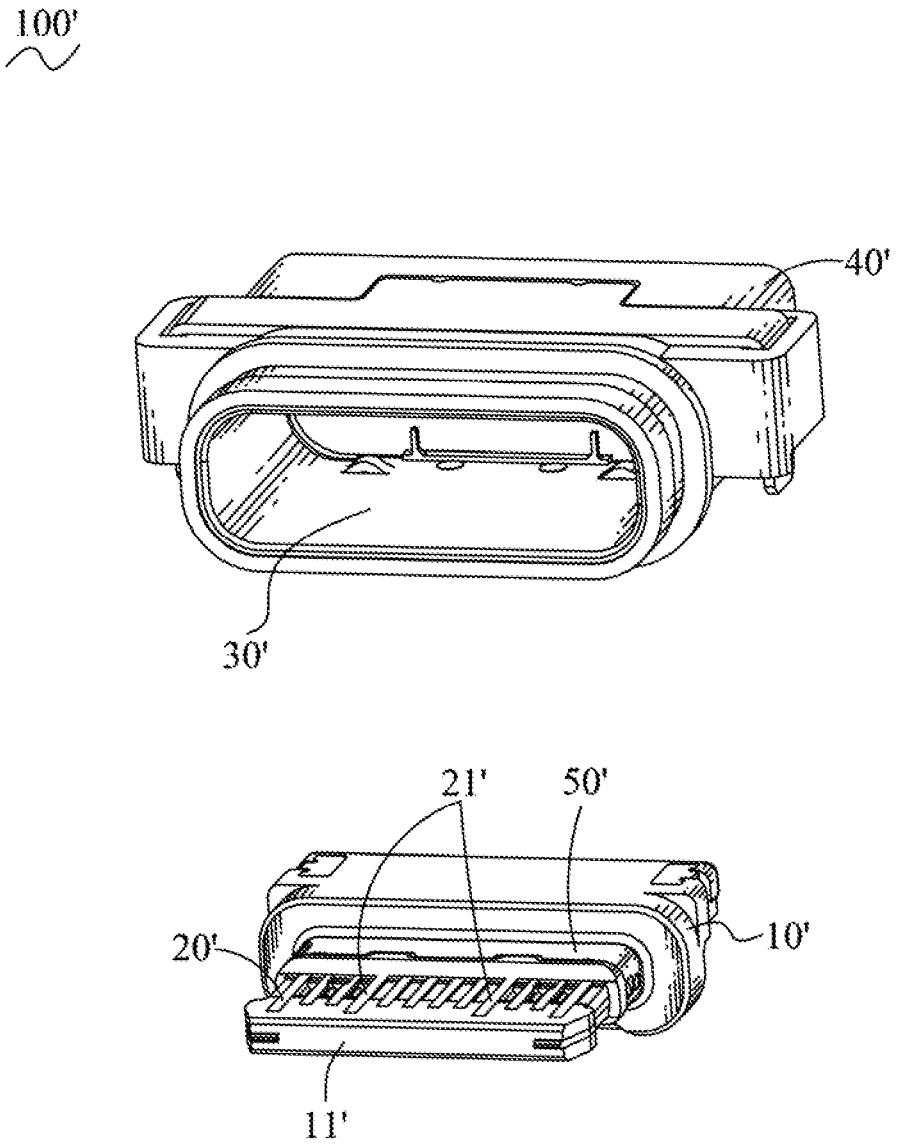
FIG. 10 (Prior Art)
FIG. 10 is a partially exploded perspective view of a conventional waterproof connector in prior art.
Figure 11:
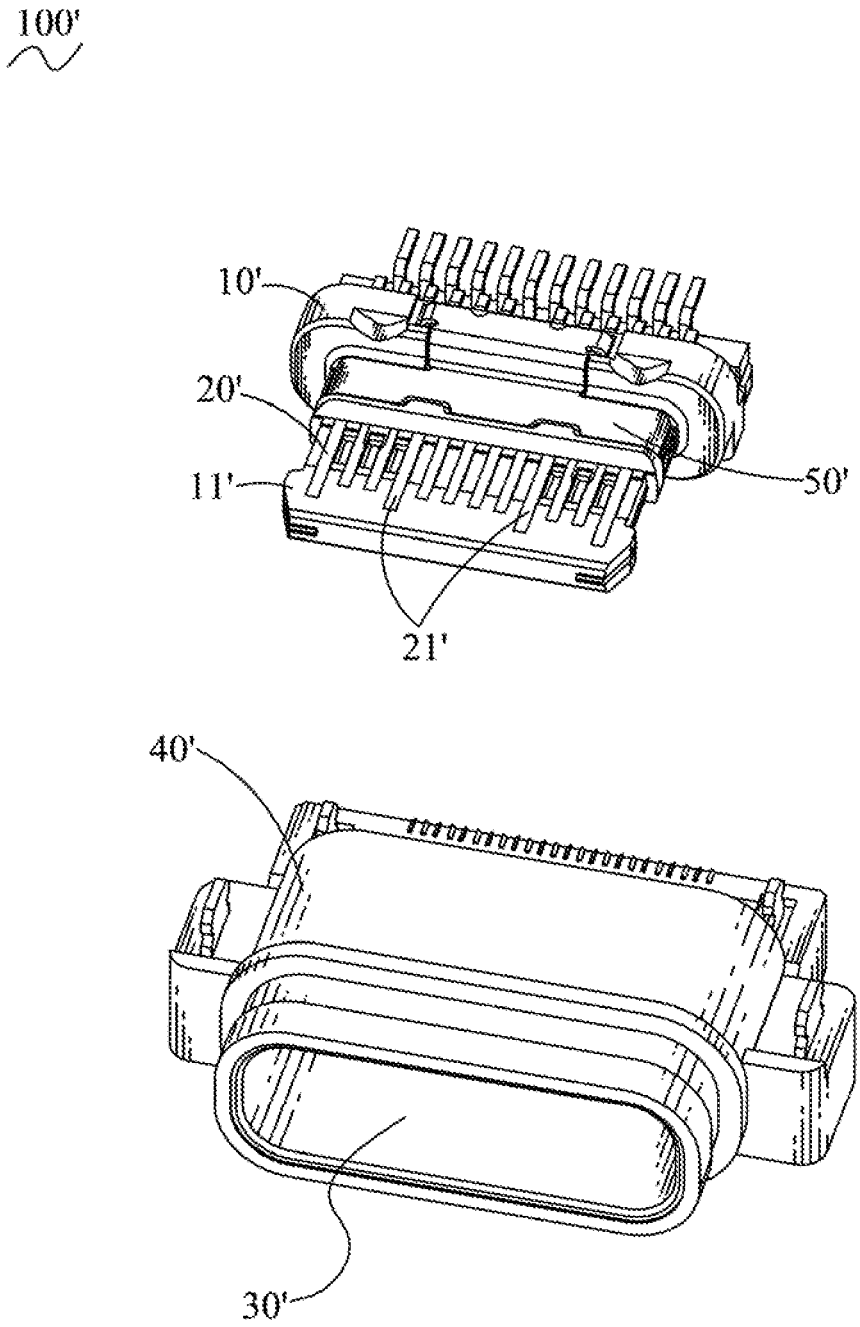
FIG. 11 (Prior Art)
FIG. 11 is another partially exploded perspective view of the conventional waterproof connector of FIG. 10.

Referring to FIG. 1 to FIG. 3, in the first preferred embodiment, preferably, the plurality of the insulation glues 91 are coated on the outer surfaces of the rear ends of the contact portions 202 of the plurality of the terminals 20 exposed to the top surface and the bottom surface of the front of the tongue board 11 and adjacent to the front end of the shielding assembly 40.

Referring to FIG. 1 to FIG. 8, in the second preferred embodiment, the outer surfaces of the rear ends of the contact portions 202 of the plurality of the power terminals 23 exposed to the top surface and the bottom surface of the front of the tongue board 11 and adjacent to the front end of the shielding assembly 40 are recessed inward to form a plurality of avoiding areas 25. A portion of the contact portion 202 of the at least one terminal 20 adjacent to the front end of the shielding assembly 40 is recessed inward to form the avoiding area 25. The avoiding area 25 is covered by a part of the surface of the tongue board 11. The avoiding groove 401 is corresponding to the avoiding area 25 of the at least one terminal 20 along a front-to-rear direction. The plurality of the avoiding areas 25 are a plurality of avoiding spaces. The plurality of the insulation elements 90 are a plurality of blocking boards 92. The plurality of the blocking boards 92 are protruded into several of the upper terminal grooves 112 and the lower terminal grooves 111 from the tongue board 11 and located in front of the limiting groove 113. The plurality of the blocking boards 92 are protruded frontward from a front surface of a front wall of the limiting groove 113 and project into rears of the several of the upper terminal grooves 112 and the lower terminal grooves 111. Each of the plurality of the blocking boards 92 is corresponding to one of the upper terminal grooves 112 and the lower terminal grooves 111. Each of the plurality of the blocking boards 92 is spaced from an inner wall of the one of the upper terminal grooves 112 and the lower terminal grooves 111 facing the blocking board 92 corresponding to the one of the upper terminal grooves 112 and the lower terminal grooves 111. An outer surface of each of the plurality of the blocking boards 92 exposed to the top surface or the bottom surface of the front of the tongue board 11 is flush with the top surface or the bottom surface of the front of the tongue board 11. Each of the plurality of the avoiding areas 25 is located under or above one of the plurality of the blocking boards 92. Each of the plurality of the avoiding areas 25 is matched with the one of the plurality of the blocking boards 92. Each of the plurality of the blocking boards 92 is received in one of the plurality of the avoiding areas 25 which are the avoiding spaces.

Referring to FIG. 1 to FIG. 8, in the second preferred embodiment, preferably, the outer surfaces of the rear ends of the contact portions 202 of the plurality of the terminals 20 exposed to the top surface and the bottom surface of the front of the tongue board 11 and adjacent to the front end of the shielding assembly 40 are recessed inward to form the plurality of the avoiding areas 25. The plurality of the avoiding areas 25 are avoiding spaces. The plurality of the blocking boards 92 are protruded into the upper terminal grooves 112 and the lower terminal grooves 111 from the tongue board 11 and located in front of the limiting groove 113. The plurality of the blocking boards 92 are protruded frontward from the front surface of the front wall of the limiting groove 113 and project into rears of the upper terminal grooves 112 and the lower terminal grooves 111. Each of the plurality of the blocking boards 92 is corresponding to the one of the upper terminal grooves 112 and the lower terminal grooves 111. Each of the plurality of the blocking boards 92 is spaced from the inner wall of the one of the upper terminal grooves 112 and the lower terminal grooves 111 facing the blocking board 92 corresponding to the one of the upper terminal grooves 112 and the lower terminal grooves 111. The outer surface of each of the plurality of the blocking boards 92 exposed to the top surface or the bottom surface of the front of the tongue board 11 is flush with the top surface or the bottom surface of the front of the tongue board 11. When the plurality of the terminals 20 are integrally molded in the dielectric body 10, the contact portions 202 of the plurality of the terminals 20 are received in the upper terminal grooves 112 and the lower terminal grooves 111 and exposed to the top surface and the bottom surface of the front of the tongue board 11. Each of the plurality of the avoiding areas 25 is located under or above the one of the plurality of the blocking boards 92. Each of the plurality of the avoiding areas 25 is matched with the one of the plurality of the blocking boards 92. Each of the plurality of the blocking boards 92 is received in the one of the plurality of the avoiding areas 25 which are the avoiding spaces. In this embodiment, each of the plurality of the blocking boards 92 includes a lower surface inclining downwardly from the front-to-rear direction.

As described above, the outer surfaces of the rear ends of the contact portions 202 of the plurality of the terminals 20 exposed to the top surface and the bottom surface of the front of the tongue board 11 and adjacent to the front end of the shielding assembly 40 have the plurality of insulation elements 90 which are the insulation glues 91 or the blocking boards 92, when the waterproof connector 100 is used before the waterproof connector 100 is dried, the front end of the shielding assembly 40 is near to the rear ends of the contact portions 202 of the plurality of the terminals 20 exposed to the top surface and the bottom surface of the front of the tongue board 11, when the liquids flow to the position between the rear ends of the contact portions 202 of the plurality of the terminals 20 and the front end of the shielding assembly 40, the rear ends of the contact portions of the plurality of the terminals 20 and the front end of the shielding assembly 40 are prevented from being conducting to cause a short circuit on account of an insulating function of each of the plurality of the insulation elements 90.

What is claimed is:

1. A waterproof connector, comprising:

a dielectric body having a base portion, and a tongue board protruded from a middle of a front surface of the base portion, a top surface of a front of the tongue board opening a plurality of upper terminal grooves, a bottom surface of the front of the tongue board opening a plurality of lower terminal grooves, a periphery of a rear of the tongue board being recessed inward to form a limiting groove, a plurality of blocking boards being protruded into the upper terminal grooves and the lower terminal grooves from the tongue board and located in front of the limiting groove;

a plurality of terminals integrally molded to the dielectric body, including a plurality of lower terminals arranged transversely and a plurality of upper terminals arranged transversely, each of the plurality of the terminals having a fastening portion, a contact portion connected with a front end of the fastening portion, and a soldering portion connected with a rear end of the fastening portion, the fastening portions of the plurality of the terminals being integrally molded in and fastened in the dielectric body, the contact portions of the plurality of the lower terminals and the upper terminals being received in the plurality of the lower terminal grooves and the upper terminal grooves and being exposed to the bottom surface and the top surface of the front of the tongue board, the soldering portions of the plurality of the terminals projecting beyond a rear surface of the dielectric body;

a shielding assembly being limited in the limiting groove of the dielectric body;

a metal shell surrounding outside the dielectric body to which the plurality of the terminals are integrally molded; and a waterproof housing integrally molded outside the metal shell, wherein outer surfaces of rear ends of the contact portions of the plurality of the terminals exposed to the top surface and the bottom surface of the front of the tongue board and adjacent to a front end of the shielding assembly are recessed inward to form a plurality of avoiding areas, each of the plurality of the blocking boards is corresponding to one of the upper terminal grooves and the lower terminal grooves, each of the plurality of the blocking boards is spaced from an inner wall of the one of the upper terminal grooves and the lower terminal grooves facing the blocking board corresponding to the one of the upper terminal grooves and the lower terminal grooves, each of the plurality of the avoiding areas is located under or above one of the plurality of the blocking boards, each of the plurality of the avoiding areas is matched with the one of the plurality of the blocking boards.

2. The waterproof connector as claimed in claim 1, wherein the plurality of the avoiding areas are a plurality of avoiding spaces, each of the plurality of the blocking boards is received in one of the plurality of the avoiding areas.

3. The waterproof connector as claimed in claim 1, wherein the plurality of the blocking boards are protruded frontward from a front surface of a front wall of the limiting groove and project into rears of the upper terminal grooves and the lower terminal grooves.

4. The waterproof connector as claimed in claim 1, wherein an outer surface of each of the plurality of the blocking boards exposed to the top surface or the bottom surface of the front of the tongue board is flush with the top surface or the bottom surface of the front of the tongue board.

5. The waterproof connector as claimed in claim 1, wherein the shielding assembly includes an upper shielding element and a lower shielding element, the upper shielding element is mounted in an upper portion and two opposite sides of the limiting groove, the lower shielding element is mounted in a lower portion and the two opposite sides of the limiting groove, the upper shielding element and the lower shielding element are fastened with each other by virtue of a buckling way, the lower shielding element abuts against a bottom plate of the metal shell.

6. The waterproof connector as claimed in claim 5, wherein the upper shielding element and the lower shielding element are fastened with each other by a laser spot welding technology.

7. The waterproof connector as claimed in claim 5, wherein two opposite sides of a front edge of a top of the upper shielding element are recessed inward to form two first avoiding grooves, two opposite sides of a front edge of a bottom of the lower shielding element are recessed inward to form two second avoiding grooves, the plurality of the terminals include a plurality of power terminals and a plurality of signal terminals, the rear ends of the contact portions of the plurality of the power terminals are located in front of the two first avoiding grooves and the two second avoiding grooves separately, an insulating distance between the front end of the shielding assembly and the rear ends of the contact portions of the plurality of the power terminals is increased by virtue of the two first avoiding grooves and the two second avoiding grooves.

8. The waterproof connector as claimed in claim 7, wherein outer surfaces of the rear ends of the contact portions of the plurality of the power terminals exposed to the top surface and the bottom surface of the front of the tongue board and adjacent to the front end of the shielding assembly are recessed inward to form the plurality of the avoiding areas, the plurality of the blocking boards are protruded into several of the upper terminal grooves and the lower terminal grooves from the tongue board and located in front of the limiting groove, each of the plurality of the avoiding areas is located under or above the one of the plurality of the blocking boards, each of the plurality of the avoiding areas is matched with the one of the plurality of the blocking boards.

9. The waterproof connector as claimed in claim 8, wherein the plurality of the avoiding areas are a plurality of avoiding spaces, each of the plurality of the blocking boards is received in one of the plurality of the avoiding areas.

10. The waterproof connector as claimed in claim 8, wherein the plurality of the blocking boards are protruded frontward from a front surface of a front wall of the limiting groove and project into rears of the several of the upper terminal grooves and the lower terminal grooves.

11. The waterproof connector as claimed in claim 1, wherein each of the plurality of lower terminals has a lower fastening portion, a lower contact portion connected with a front end of the lower fastening portion, and a lower soldering portion connected with a rear end of the lower fastening portion, each of the plurality of the upper terminals has an upper fastening portion, an upper contact portion connected with a front end of the upper fastening portion, and an upper soldering portion connected with a rear end of the upper fastening portion, the lower fastening portions of the plurality of lower terminals and the upper fastening portions of the plurality of the upper terminals are integrally molded in and fastened in the dielectric body, the lower contact portions of the plurality of the lower terminals are received in the plurality of the lower terminal grooves and are exposed to the bottom surface of the front of the tongue board, the upper contact portions of the plurality of the upper terminals are received in the plurality of the upper terminal grooves and are exposed to the top surface of the front of the tongue board, the lower soldering portions of the plurality of lower terminals and the upper soldering portions of the plurality of the upper terminals project beyond the rear surface of the dielectric body.

12. The waterproof connector as claimed in claim 1, further comprising an isolating plate disposed between the plurality of the lower terminals and the plurality of the upper terminals, the isolating plate, the plurality of the lower terminals and the plurality of the upper terminals being integrally molded together in the dielectric body.

13. The waterproof connector as claimed in claim 12, further comprising a waterproof cover, a rear end of a bottom of the waterproof housing opening an assembling groove corresponding to upper portions of the soldering portions of the plurality of the terminals, an upper portion of a rear of the waterproof housing opening a guiding hole penetrating rearward through a rear surface of the waterproof housing and extending forward to the assembling groove, two opposite sides of a rear of the dielectric body opening two fastening grooves, two opposite sides of a bottom surface of a top wall of the assembling groove protruding downward to form two supporting portions fastened in the two fastening grooves, the waterproof cover being integrally molded to the assembling groove and the guiding hole, and located above the soldering portions for effectively sealing intervals among the soldering portions, the dielectric body, the isolating plate, the metal shell and the waterproof housing, two opposite sides of a top surface of the waterproof cover protruding upward to form two propping portions abutting against the two supporting portions, respectively.

14. The waterproof connector as claimed in claim 1, further comprising a fastening element which includes a board-shaped connecting portion, and two soldering feet bent downward from two opposite sides of the connecting portion, the connecting portion being integrally molded to and fastened to the waterproof housing, a top surface of the connecting portion being exposed out of a top surface of the waterproof housing, the two soldering feet passing through two opposite sides of the waterproof housing and projecting beyond bottom surfaces of the two opposite sides of the waterproof housing.

15. A waterproof connector, comprising:

a dielectric body having a base portion, and a tongue board protruded from a middle of a front surface of the base portion, a top surface of a front of the tongue board opening a plurality of upper terminal grooves, a bottom surface of the front of the tongue board opening a plurality of lower terminal grooves, a periphery of a rear of the tongue board being recessed inward to form a limiting groove;

a plurality of terminals integrally molded to the dielectric body, including a plurality of lower terminals arranged transversely and a plurality of upper terminals arranged transversely, each of the plurality of the terminals having a fastening portion, a contact portion connected with a front end of the fastening portion, and a soldering portion connected with a rear end of the fastening portion, the fastening portions of the plurality of the terminals being integrally molded in and fastened in the dielectric body, the contact portions of the plurality of the lower terminals and the upper terminals being received in the plurality of the lower terminal grooves and the upper terminal grooves and being exposed to the bottom surface and the top surface of the front of the tongue board, the soldering portions of the plurality of the terminals projecting beyond a rear surface of the dielectric body;

a shielding assembly being limited in the limiting groove of the dielectric body;

a metal shell surrounding outside the dielectric body to which the plurality of the terminals are integrally molded; and a waterproof housing integrally molded outside the metal shell, wherein a plurality of insulation glues are coated on outer surfaces of rear ends of the contact portions of the plurality of the terminals exposed to the top surface and the bottom surface of the front of the tongue board and adjacent to a front end of the shielding assembly.

16. The waterproof connector as claimed in claim 15, wherein the plurality of the terminals include a plurality of power terminals, the outer surfaces of the rear ends of the contact portions of the plurality of the power terminals exposed to the top surface and the bottom surface of the front of the tongue board and adjacent to the front end of the shielding assembly are coated with the plurality of the insulation glues.

17. The waterproof connector as claimed in claim 15, wherein the shielding assembly includes an upper shielding element and a lower shielding element, the upper shielding element is mounted in an upper portion and two opposite sides of the limiting groove, the lower shielding element is mounted in a lower portion and the two opposite sides of the limiting groove, the upper shielding element and the lower shielding element are fastened with each other by virtue of a buckling way, the lower shielding element abuts against a bottom plate of the metal shell.

18. The waterproof connector as claimed in claim 17, wherein two opposite sides of a front edge of a top of the upper shielding element are recessed inward to form two first avoiding grooves, two opposite sides of a front edge of a bottom of the lower shielding element are recessed inward to form two second avoiding grooves, the plurality of the terminals include a plurality of power terminals, the rear ends of the contact portions of the plurality of the power terminals are located in front of the two first avoiding grooves and the two second avoiding grooves separately, an insulating distance between the front end of the shielding assembly and the rear ends of the contact portions of the plurality of the power terminals is increased by virtue of the two first avoiding grooves and the two second avoiding grooves.

19. A waterproof connector, comprising:

a dielectric body having a tongue board;

at least one terminal received in the dielectric body, the at least one terminal having a fastening portion received in the dielectric body, a contact portion exposed to a surface of the tongue board, and a soldering portion projecting beyond the dielectric body;

a shielding assembly being limited in a rear portion of the tongue board, the shielding assembly being comprised of integrated parts; and a metal shell surrounding outside the dielectric body;

wherein a portion of the contact portion of the at least one terminal adjacent to a front end of the shielding assembly is recessed inward to form an avoiding area, the avoiding area is covered by a part of the surface of the tongue board;

wherein a front edge of the shielding assembly is recessed rearwardly to form at least one avoiding groove, the avoiding groove is corresponding to the avoiding area of the at least one terminal along a front-to-rear direction.

20. The waterproof connector as claimed in claim 19, further comprising a waterproof housing and a waterproof cover, the waterproof housing integrally molded outside the metal shell, a rear end of a bottom of the waterproof housing opening an assembling groove corresponding to the soldering portion of the at least one terminal, an upper portion of a rear of the waterproof housing opening a guiding hole penetrating rearward through a rear surface of the waterproof housing and extending forward to the assembling groove, the waterproof cover being integrally molded to the assembling groove and the guiding hole, and located above the soldering portion of the at least one terminal.

* * * * *